US005820396A

United States Patent [19]

Pan et al.

[11] Patent Number: 5,820,396

[45] Date of Patent: Oct. 13, 1998

[54] RETENTION DEVICE FOR CARD EDGE CONNECTOR

[75] Inventors: Hua-Tseng Pan, Taipei; Yung-Fu Cheng, Chung Ho; Ming-Yow Hong, Yung Ho, all of Taiwan

[73] Assignee: Hon Hai Precision Ind. Co., Ltd., Taipei Hsien, Taiwan

[21] Appl. No.: 767,540

[22] Filed: Dec. 16, 1996

[51] Int. Cl.[6] ..... H01R 13/62

[52] U.S. Cl. ..... 439/328

[58] Field of Search ..... 439/327–329, 439/64, 157, 629–637

[56] References Cited

U.S. PATENT DOCUMENTS

| | | | |
|---|---|---|---|
| 5,211,568 | 5/1993 | Yamada et al. | 439/157 |
| 5,242,312 | 9/1993 | Tondreault | 439/328 |
| 5,389,000 | 2/1995 | DiViesti et al. | 439/328 |
| 5,417,580 | 5/1995 | Tsai | 439/328 |
| 5,647,755 | 7/1997 | Hida et al. | 439/328 |

*Primary Examiner*—Hien Vu

[57] ABSTRACT

A card edge connector (10) includes an insulative elongated housing (12) defining a central slot (14) for receiving a card (100). A plurality of passageways (16) are formed by two sides of the central slot (14) for receiving a corresponding number of contacts (18) therein. An upstanding high retention device (20) positioned at either opposite end of the housing (12), includes a pair of side arms (24) for transversely sandwiching the side edge portion (104) of the card, and an engagement arm (36) positioned between such pair of side arms (24) for longitudinally abutting against the side edge (106) of the card (100) whereby the card (100) is reliably and efficiently retained in the housing (12) by the retention device (20).

4 Claims, 5 Drawing Sheets

RETENTION DEVICE FOR CARD EDGE CONNECTOR

BACKGROUND OF THE INVENTION

1. Field of The Invention

The invention relates to a card edge connector, and particularly to the retention device for use with the card edge connector for retaining the card within the connector.

2. The Related Art

As shown in FIGS. 1(A) and 1(B), U.S. Pat. No. 5,407,365 discloses a traditional card edge connector 1 including an insulative elongated housing 2 defining a central slot 3 for receiving therein a card 4 wherein a fork type retention device 5 is embedded within the housing 2 for sandwiching the lower edge portion of the inserted card in the central slot 3.

The disadvantage of this type retention device is that the retention action region is only fallen within the central slot 3 and only transverse retention is provided therewith. In other words, only the lower edge portion of the card is actuated along the transverse direction. From the mechanical viewpoint, this is not a reliable and scientific feature for the retention purpose. The intermittence problem due to the poor retention may come out when many or heavy chip components are mounted on the card and during a severe vibration situation.

Therefore, it is desired to have the retention device not only actuate the card both in the transverse and longitudinal directions, but also both on the upper and lower portions of the card.

SUMMARY OF THE INVENTION

According to an aspect of the invention, a card edge connector includes an insulative elongated housing defining a central slot for receiving a card. A plurality of passageways are formed by two sides of the central slot for receiving a corresponding number of contacts therein. An upstanding high retention device positioned at either opposite end of the housing, includes a pair of side arms for transversely sandwiching the side edge portion of the card, and an engagement arm positioned between such pair of side arms for longitudinally abutting against the side edge of the card whereby the card is reliably and efficiently retained in the housing by the retention device.

DETAILED DESCRIPTION OF THE PREFERRED EMBODIMENTS

Figure 1A:
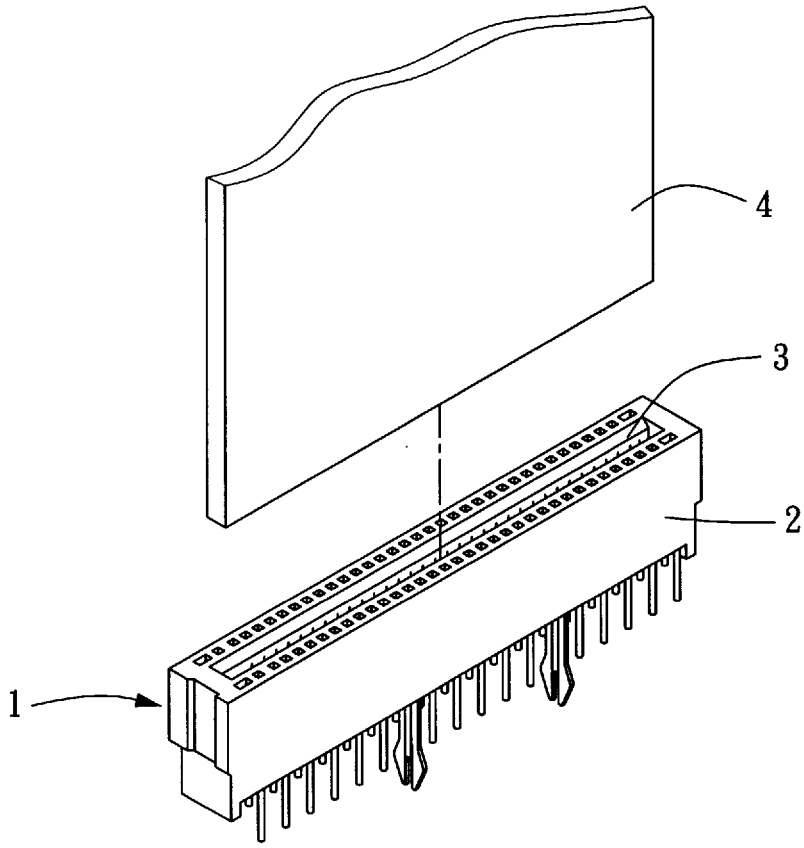
FIG. 1A (PRIOR ART)
FIG. 1(A) is a perspective view of a prior art card edge connector adapted to receive a card therein.
Figure 1B:
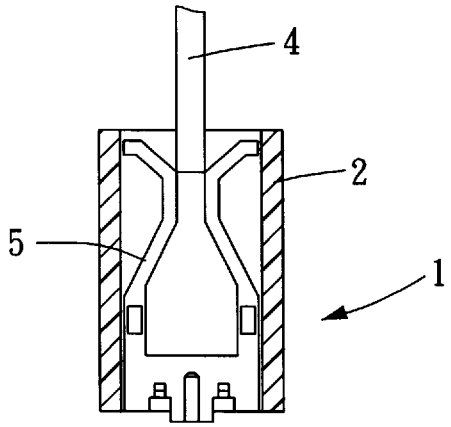
FIG. 1B (PRIOR ART)
FIG. 1(B) is a cross-sectional view of the card edge connector of FIG. 1(A).
Figure 2:
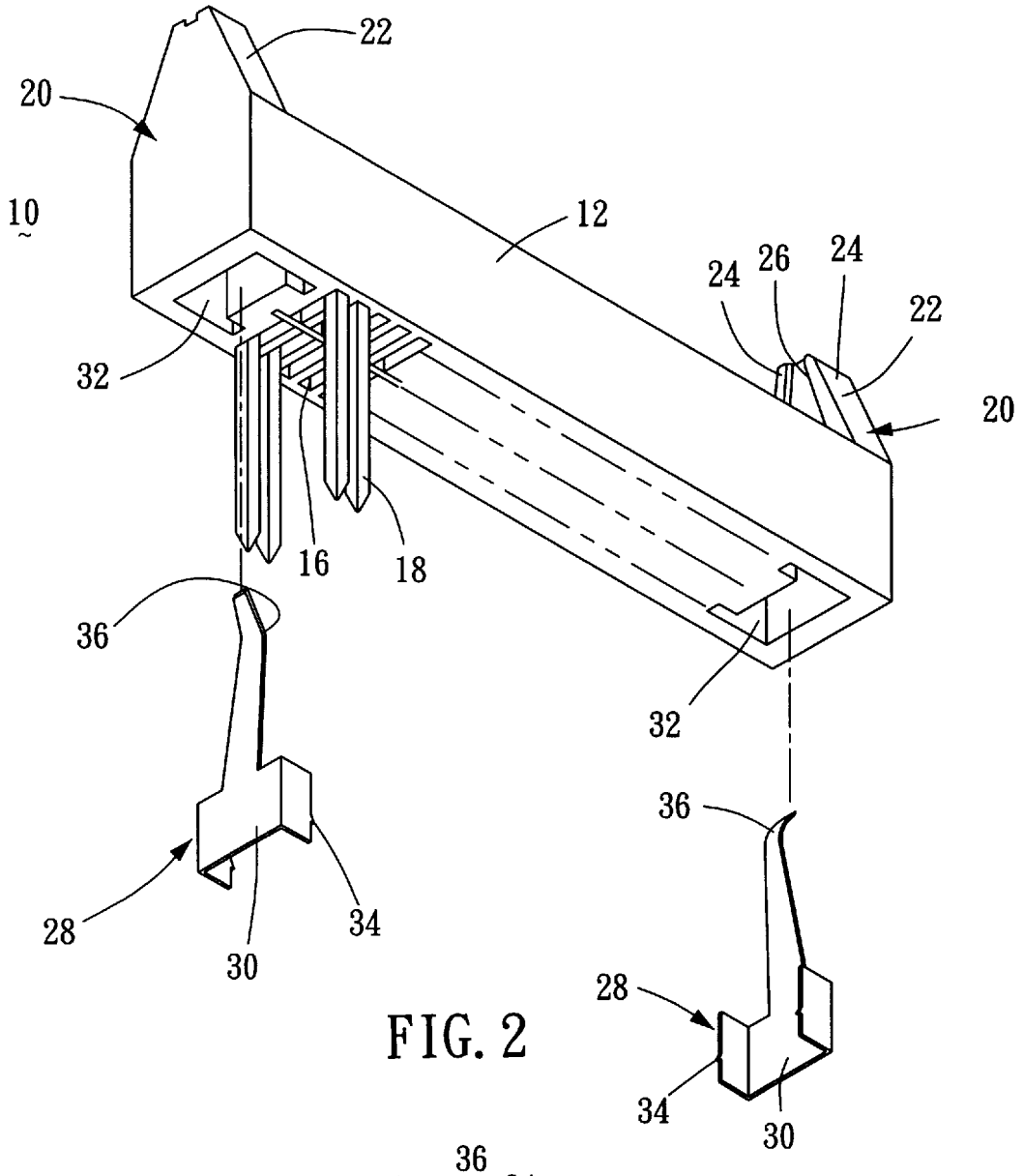
FIG. 2 is an exploded perspective view of a first embodiment of a card edge connector according to the invention.
Figure 3:
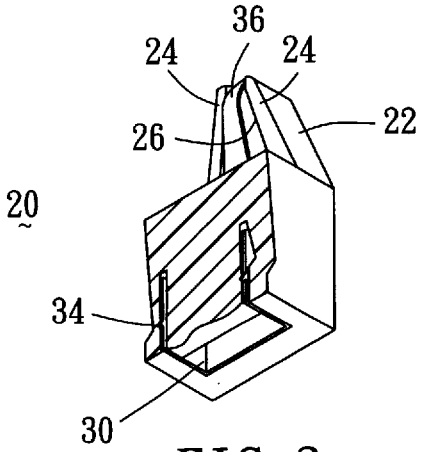
FIG. 3 is a fragmentary perspective view of an assembled card edge connector of FIG. 2.
Figure 4:
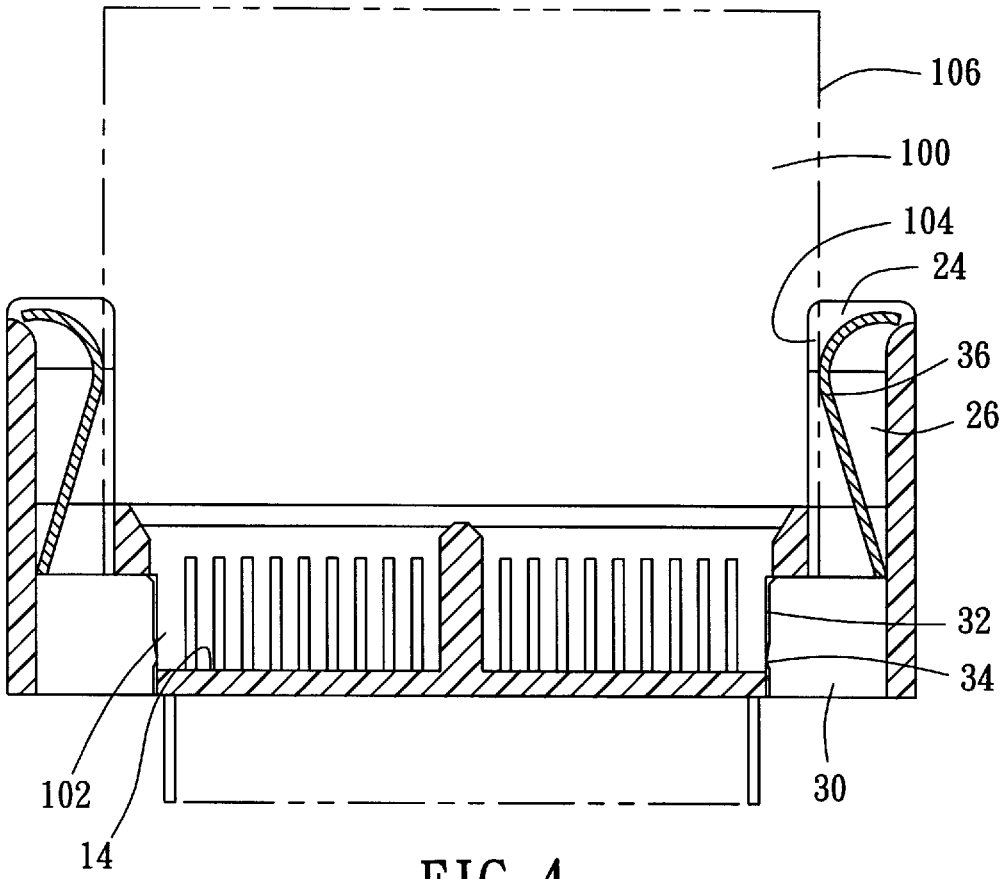
FIG. 4 is a cross-sectional view of the card edge connector of FIG. 2 along the lengthwise direction.
Figure 5:
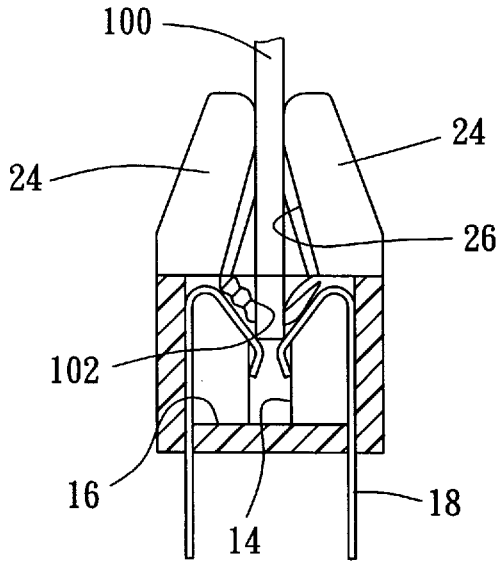
FIG. 5 is a cross-sectional view of the card edge connector of FIG. 2 along the transverse direction.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 2–5 wherein a card edge connector 10 includes an insulative elongated housing 12 defining a central slot 14 (FIGS. 4 and 5) for receiving a lower edge portion 102 of a card 100 therein. A plurality of passageways 16 (FIG. 5) are disposed by two sides of the central slot 14 for respectively receiving a corresponding number of contacts 18 therein.

A pair of retention devices 20 are positioned at two opposite ends of the housing 12 wherein each retention device 20 includes an upstanding tower section 22 integrally extending with the housing 12. The tower section 22 defines a pair of side arms 24 forming a converging opening 26 at the top in compliance with the thickness of the inserted card 100 for transversely sandwiching the side edge portion 104 of the card 100 therebetween. The retention device 20 further includes a metal spring tang 28 having a U-shaped base 30 interferentially engaged within a cavity 32 in the housing 12 by means of barbs 34 thereon. The spring tang 28 is generally positioned between such pair of side arms 24 and has an inward projecting tip section 36 which can properly abut against the side edge 106 of the card 100.

Therefore, the inserted card 100 can have its lower edge portion 102 retainably engaged with the corresponding plural contacts 18, its upper side edge portion 106 engaged with the pair of side arms 24 of the retention device 20 transversely, and its upper side edge 106 engaged with the spring tang 28 longitudinally whereby a reliable and good retention of the card is provided.

Figure 6:
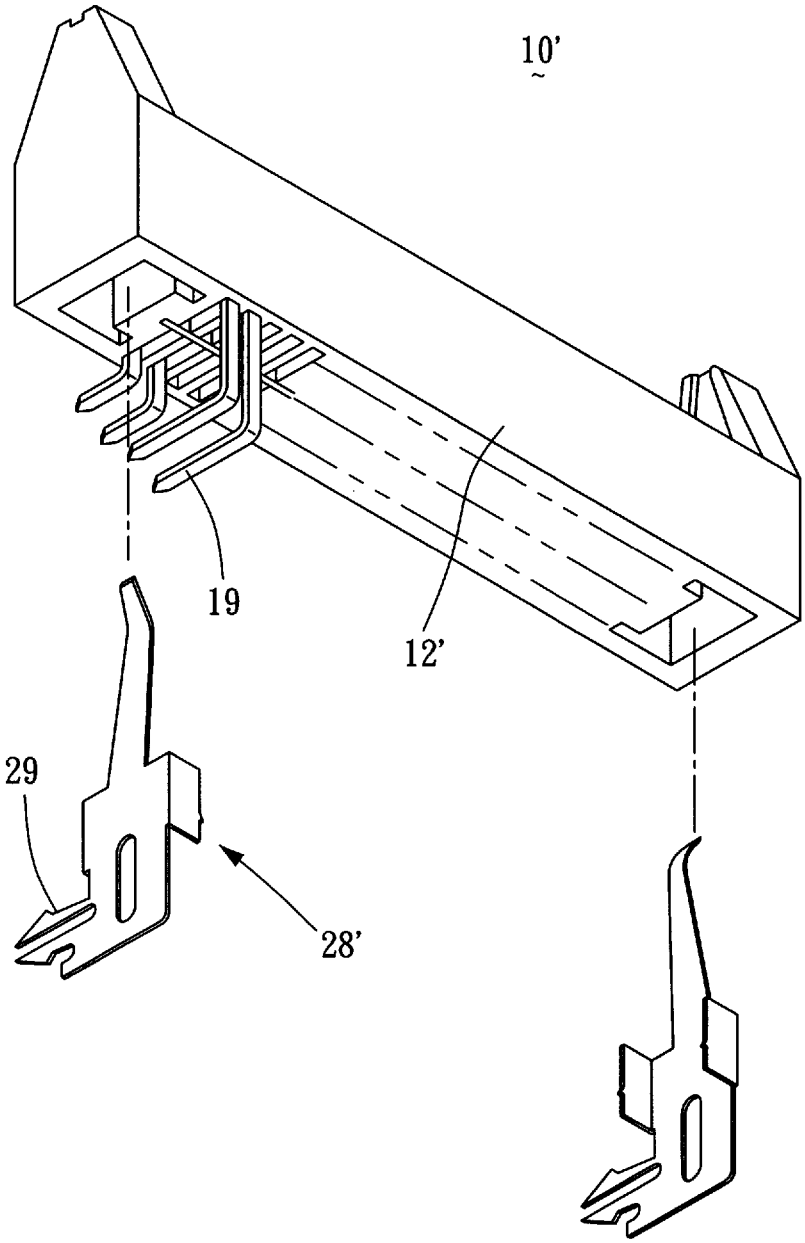
FIG. 6 is an exploded perspective view of a second embodiment of the card edge connector.

FIG. 6 shows another embodiment wherein the connector 10' is not mounted on the PC board vertically but at a right angle. Thus, the contact tails 19 and the tail 29' of the spring tang 28' extend at a right angle with regard to the housing 12' for compliance with the application configuration.

Figure 7:
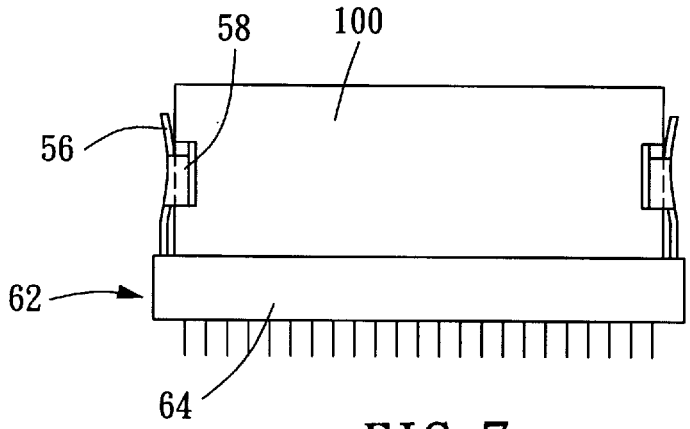
FIG. 7 is a plan view of a third embodiment of a retention device and the associated card edge connector.
Figure 7A:
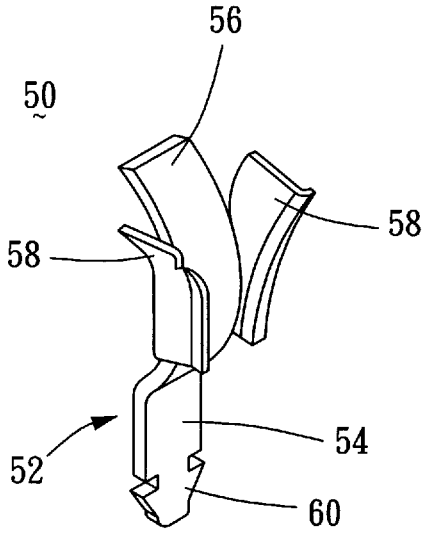
FIG. 7(A) is a perspective view of the retention device of FIG. 7.

FIGS. 7 and 7(A) show another embodiment wherein the retention device 50 is substantially a one-piece metal member 52. The metal member 52 includes a main body 54 having a generally curvilinearly inward extending tang 56 with a pair of side arms 58 integrally extending thereby, and a base 60 for securing the metal member 52 in a cavity (not shown) of the housing 64 of the connector 62.

Figure 8:
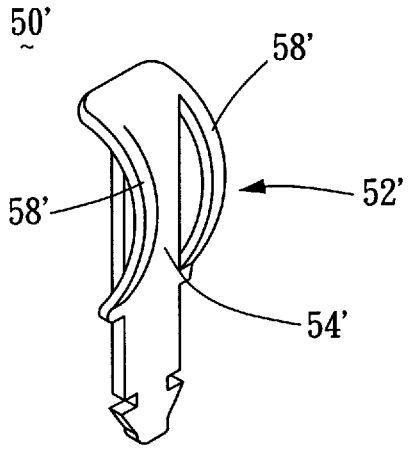
FIG. 8 is a perspective view of a fourth embodiment of the 5 retention device for use with the card edge connector.

Similarly, FIG. 8 shows another embodiment of the retention device 50' made by one-piece member 52' wherein two side arms 58' are split from the main body 54', i.e., not by bending as show in FIG. 7. The spring tang 56 (56') and the side arms 58 (58') in the third and the fourth embodiments are used similar to those in the first and the second embodiments.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A card edge connector assembly including:

an insulative elongated housing defining a central slot for receiving a card therein and two opposite longitudinal ends;

a plurality of passageways disposed at two sides of the central slot in the housing for receiving a corresponding number of contacts therein; and a pair of upstanding retention devices fixed to the two opposite longitudinal ends of the housing, each of said retention devices including a spring tang and a pair of side arms, said spring tang having a first card engaging portion oriented in a longitudinal direction, each of said side arms having a second card engaging portion oriented in a transverse direction orthogonal to the longitudinal direction so that when the card is inserted into the connector and received in the central slot, the spring tang engages a side edge of the card in the longitudinal direction and the side arms engage the side edge of the card in the transverse direction orthogonal to the longitudinal direction.

2. The card edge connector assembly in accordance with claim 1, wherein each retention device has an upper end distant to the housing, and the first and second card engaging portions are located near the upper end.

3. The assembly as defined in claim 2, wherein the side arms are integrally formed with the housing and the spring tang is independently inserted into a cavity of the housing whereby the spring tang is positioned between said side arms.

4. The assembly is defined in claim 2, wherein the retention device is made by a one-piece metal member.

* * * * *